United States Patent [19]

Aumueller et al.

[11] Patent Number: 4,897,289

[45] Date of Patent: Jan. 30, 1990

[54] PRODUCTION OF AN ELECTRICALLY CONDUCTIVE SURFACE LAYER ON MOLDINGS CONSISTING OF PLASTICS

[75] Inventors: Alexander Aumueller, Ludwigshafen; Peter Neumann, Wiesloch; Gerd Blinne, Bobenheim; Gerhard Lindenschmidt, Leimen, all of Fed. Rep. of Germany

[73] Assignee: BASF Aktiengesellschaft, Ludwigshafen, Fed. Rep. of Germany

[21] Appl. No.: 312,310

[22] Filed: Feb. 17, 1989

Related U.S. Application Data

[63] Continuation of Ser. No. 56,705, Jun. 2, 1987, abandoned.

[30] Foreign Application Priority Data

Jun. 11, 1986 [DE] Fed. Rep. of Germany ..... 3619606

[51] Int. Cl.[4] ..... B05D 5/12

[52] U.S. Cl. ..... 427/125; 427/307; 427/333; 427/337; 427/384; 427/393.5

[58] Field of Search ..... 427/125, 307, 333, 337, 427/384, 393.5

[56] References Cited

FOREIGN PATENT DOCUMENTS 134026 3/1985 European Pat. Off. .

1067260 5/1967 United Kingdom .

*Primary Examiner*—Bernard Pianalto

*Attorney, Agent, or Firm*—Oblon, Spivak, McClelland, Maier & Neustadt

[57] ABSTRACT

An electrically conductive surface layer is produced on moldings consisting of plastics which are soluble or swellable in organic solvents, the conductivity of the said layer being based on a system, incorporated therein, of organic electron acceptors (I) on the one hand and organic electron donors (II), iodides (III) or a mixture of (II) and (III) as electron donors, on the other hand, by a process in which the moldings are treated with organic solutions of these components.

The products have a surface resistance of from $10^8$ to $10^2$ ohm and have the advantage that the remaining properties of the moldings are virtually unaffected by the agents (I) to (III).

15 Claims, No Drawings

PRODUCTION OF AN ELECTRICALLY CONDUCTIVE SURFACE LAYER ON MOLDINGS CONSISTING OF PLASTICS

This application is a continuation of application Ser. No. 07/056,705 filed on June 2, 1987, now abandoned.

The present invention relates to a novel process for the production of an electrically conductive surface layer on moldings consisting of plastics which are soluble or swellable in organic solvents, the conductivity of the said layer being based on a system, incorporated therein, of:

organic electron acceptors (I) on the one hand and organic electron donors (II), iodides (III) or a mixture of (II) and (III) as electron donors, on the other hand.

Plastics generally have a surface resistance of $10^{13}$ ohm or more and are therefore good electrical insulators. Moldings consisting of plastics can therefore become highly electrostatically charged; for many applications, it is absolutely essential to avoid this. This applies in particular where explosive gas or dust/gas mixtures may be ignited by spark discharge.

A large number of additives have been developed for providing plastics with an antistatic treatment. These substances are applied to the surface of shaped articles (G. Balbach, Kunststoffe 67 (1977), 3). As a rule, however, they become ineffective after a short time. Antistatic agents have also been incorporated into the plastics. In these cases, the properties of the plastic frequently deteriorate or the additives diffuse out. The antistatic agents impart a certain degree of hydrophilicity to the plastic surface, so that a water film, dependent on the atmospheric humidity, can form on the surface, this film preventing charging.

To render plastics antistatic, a surface resistance of $10^{10}$ ohm or less is required.

However, these minimum conductivities required to prevent electrostatic charging are not sufficient for many purposes in the electrical and electronics industries; instead, surface resistance of less than $10^8$ ohm are required here. For example, there is an increasing demand for moldings capable of shielding electromagnetic fields. Of course, their use in this respect depends on the conductivity achieved. It is important that the remaining properties of the plastics, such as thermal and mechanical stability, are not adversely affected by additives which impart conductivity.

In order to render polymers electrically conductive, attempts have been made to incorporate inorganic, electrically conductive substances, for example metals, metal oxides, metal sulfides, carbon black or graphite. However, the amount required for a desired conductivity, which as a rule is from 10 to 30% by weight, based on the plastic, causes a decisive deterioration in the mechanical properties of the plastic.

Organic additives which have a high electrical conductivity and are more compatible with plastics have also been used. These include charge-transfer complexes (CT complexes) and radical ion salts. The CT complexes are two-component systems consisting of certain organic compounds which act as electron acceptors and electron donors and which together generally form crystalline complexes having freely mobile electrons or defect electrons which give rise to conductivity. The radical ion salts formed from iodides and electron acceptors show similar behavior. Here, the $I^-$ anion donates a charge to the electron acceptor and is oxidized to elemental iodine. An electron acceptor anion is produced in which the accepted electron is once again freely mobile, so that a crystallite of a salt of this type has high electrical conductivity.

German Pat. No. 31 31 251 discloses polystyrene moldings which are prepared in a particular manner and into which from 0.8 to 1.6% by weight of a CT complex have been incorporated. The specific conductivity of this material is from $10^{-6}$ to $10^{-2}$ S/cm, but it has the fundamental disadvantage that the CT complex is distributed over the entire material, which as a rule, for example for shielding purposes, is not necessary.

Furthermore, DE-B-15 44 976 discloses that nitrogen-containing polymers can be rendered conductive by adding radical ion salts to the melt.

According to European Pat. No. 134 026, plastics moldings having high surface conductivity are obtainable by using for their preparation polymers which contain from 0.2 to 5% by weight of an electron acceptor in the melt. After the shaping procedure, the molding is immersed in a bath which contains an electron donor. The latter diffuses into the molding and, together with the electron acceptor already present, forms, in the surface layer, the CT complex which imparts surface conductivity. This process too has serious disadvantages:

(i) the major part of the expensive electron acceptor remains unused and (ii) the other properties of the polymer are adversely affected by the large amount of electron acceptor.

It is an object of the present invention to produce moldings having an electrically conductive surface layer and to avoid the disadvantages previously associated with this.

We have found that this object is achieved by a process for the production of an electrically conductive surface layer on moldings consisting of plastics which are soluble or swellable in organic solvents, the conductivity of the said layer being based on a system, incorporated therein, of:

organic electron acceptors (I) on the one hand and organic electron donors (II), iodides (III) or a mixture of (II) and (III) as electron donors, on the other hand, wherein the moldings are treated with organic solutions of these components.

We have furthermore found that the particular embodiments of the invention according to the subclaims are advantageous.

This process is applicable to moldings of all plastics which are soluble or swellable and hence permit diffusion of the treatment solutions into the surface of the moldings. Suitable plastics are therefore primarily thermoplastics and mixtures of these, as well as materials which are only slightly crosslinked and therefore still swellable. Homopolymers and copolymers which contain vinyl acetate, vinyl carbazole, vinyl chloride, vinylpyridine, vinylpyrrolidone, vinylidene chloride, vinylidene fluoride, p-methylstyrene, olefins, acrylic acid, acrylates, acrylamide, methacrylic acid, methacrylates, methacrylamide, maleic acid or maleates and/or whose main chain contains repeating linking units such as urethane, carbonate, ester, amide, ether, thioether, acetal, ketone or sulfonyl groups, in particular homopolymers and copolymers of styrene, $\alpha$-methylstyrene, butadiene, acrylonitrile, methacrylonitrile or $C_1$–$C_{18}$-alkyl acrylates or methacrylates, are suitable. Examples are graft copolymers of styrene, acrylonitrile, butadiene and $C_1$–$C_{18}$-alkyl acrylate and those of styrene, acrylonitrile and $C_1$–$C_{18}$-alkyl acrylates, or blends of these polymers with polymers which contain carbonate groups in the main chain. These plastics are familiar to the skilled worker and are described in, for example, H. Saechting, Kunststoff-Taschenbuch, 22nd edition, Carl Hanser Verlag 1983.

The solvents should have an adequate dissolving or swelling power for both the plastics and the components I to III. Solvents of this type are familiar to the skilled worker and can be readily determined by a few preliminary experiments. Since the components (I) and (II) are highly conjugated compounds, suitable solvents are primarily aromatic compounds such as benzene, toluene, xylene, chlorobenzene or dichlorobenzene, as well as non-aromatic solvents, such as dichloromethane, chloroform or 1,1,1-trichloroethane, especially since these generally also have a good dissolving power for plastics of all types. The solvents for (III) should preferably be polar ones, for example acetonitrile, nitromethane, dimethylformamide, dichloromethane, chloroform, 1,1,1-trichloroethane or tetrahydrofuran. It is frequently advantageous to use solvent mixtures, such as toluene/acetonitrile, chlorobenzene/dimethylformamide or xylene/tetrahydrofuran.

The concentrations of (I), (II) and (III) are preferably from 0.01 to 20% by weight but, depending on the application conditions, may also be higher, for example up to 30% by weight.

The treatment with the components (I) to (III) can be carried out either with a solution which contains (I), (II) and/or (III), or with separate solutions in succession in any desired order. The molding is preferably brought into contact with the solutions by immersion, spraying or painting, and is then dried. The treatment may also be carried out several times with the same solution, preferably with intermediate drying.

The residence time of the molding in the solutions should be chosen so that the plastic swells at the surface, so that on the one hand some of (I), (II) and/or (III) can diffuse into the surface of the molding and form the electrically conductive crystals there and, on the other hand, the molding is not irreversibly damaged. The residence time at room temperature is therefore usually from 0.5 to 120, preferably from 1 to 30, minutes. Increasing the temperature is known to accelerate physical processes, such as diffusion and swelling, so that the residence time at above room temperature can be correspondingly decreased. Drying can be effected by a conventional method, for example by means of heat or reduced pressure.

In the novel process, (I) to (III) are generally applied to the surface of the molding in a concentration of from $10^{-3}$ to 20, in particular from $10^{-2}$ to 10, g/m$^2$, so that the surface resistance of the molding generally decreases to $10^8$ to $10^2$ ohm.

Electron acceptors I which have proven useful are the tetracyanoquinodimethanes of the formula (IV)

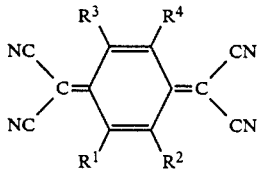

(IV)

and the N,N'-dicyanoquinonediimines of the formula (V)

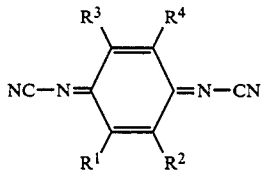

(V)

which are disclosed in German Pat. No. 34 37 814. Suitable electron donors (II) are the tetrachalcogenafulvalenes of the formula (VI)

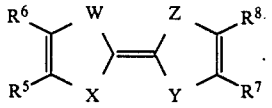

(VI)

In formulae (IV) and (V), $R^1$, $R^2$, $R^3$ and $R^4$ independently of one another are each methyl, ethyl, propyl, isopropyl, methoxy, ethoxy, propoxy, butoxy, pentyloxy, methylthio, fluorine, chlorine, bromine, cyano or, in particular, hydrogen, or one of the radicals $R^1$ and $R^2$ and/or one of the radicals $R^3$ and $R^4$ are each phenyl or butyl, or $R^1$ and $R^2$ and/or $R^3$ and $R^4$ together form a radical of the formula

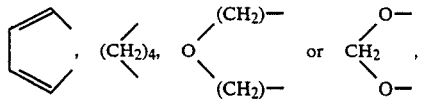

where the fused aromatic rings are unsubstituted or monosubstituted or disubstituted by chlorine, bromine or methoxy and/or methyl. In formula (VI), $R^5$, $R^6$, $R^7$ and $R^8$ independently of one another are each methyl, ethyl, phenyl, methylphenyl, methoxyphenyl or, in particular, hydrogen, or $R^5$ and $R^6$ and/or $R^7$ and $R^8$ together form a radical of the formula

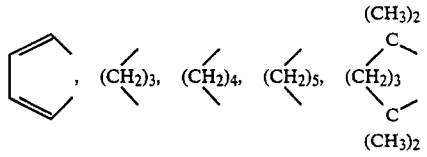

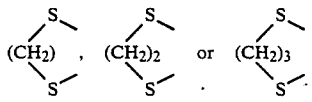

and X, Y, W and Z are each selenium or, preferably, sulfur. Iodides (III) which are usually employed are the salts of the formula $$M^{m+} I_m^-$$

where M is an m-valent alkali metal, alkaline earth metal or transition metal, tin, lead, thallium, ammonium, phosphonium, arsonium or stibonium, in particular copper, silver, pyridinium, N-methylpyridinium, quinolinium, N-methylquinolinium, phenazinium, N-methylphenazinium, tetramethylammonium, tetraethylammonium, tetrabenzylammonium, trimethylbenzylammonium or triethylbenzylammonium, and m is 1, 2 or 3.

Other suitable electron acceptors (I) are metal complexes of the formula

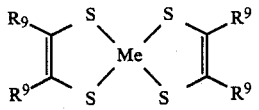

where Me is Pt or Pd and $R^9$ is —CN, —$CH_3$ or —$CF_3$, or their ammonium salts, 2,4,5-trinitro-9-(dicyanomethylene)-fluorene or tetracyanoethylene, and other suitable electron donors (II) are N-methylcarbazole, tetracene, pentacene, tetrathiatetracene

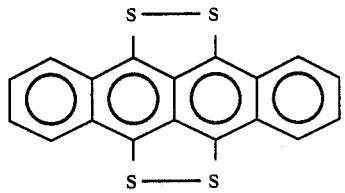

or the diazo compound

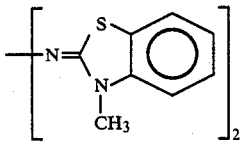

These and other suitable compounds are described in R. C. Wheland et al., J. Amer. Chem. Soc. 98 (1976), 3916.

Usually, moldings such as fibers, films or sheets, or parts produced by calendering, extrusion, injection molding or centrifugal casting, are subjected to the novel process so that they can be used as electromagnetic shielding and/or for conducting away electrostatic charges or as electric circuit paths.

The novel process can be used to produce plastics moldings which have a conductive surface and whose other properties are not adversely affected by foreign substances in the interior of the molding, such moldings being produced without loss of active substance. The process can be applied to virtually any moldings of any swellable plastics, the electrically conductive layer applied according to the invention adhering firmly to the surface of the molding.

EXAMPLE 1

A molding of a commercial ABS plastic consisting of an emulsion graft copolymer of 54% by weight of styrene, 18% by weight of butadiene and 28% by weight of acrylonitrile and having a Vicat softening temperature of 99° C., measured according to DIN 53,460 (VST/B/50) and a melt flow index of 14 g/10 min, measured according to DIN 53,735 (220/10), was immersed for 5 minutes in a solution of 1.7 g of N,N'-dicyano-p-benzoquinonediimine in 250 ml of toluene. After drying in the air, the same molding was immersed in a solution of 30 g of copper(I) iodide in 200 ml of acetonitrile, the said molding becoming coated with a bluish black layer. It was then dried in the air. The surface resistance of the molding decreased from $10^{13}$ ohm before the treatment to $1 \cdot 10^6$ ohm after the treatment.

EXAMPLE 2

A molding of a commercial ASA plastic consisting of 55% by weight of styrene, 17% by weight of n-butyl acrylate and 28% by weight of acrylonitrile and having a Vicat softening temperature of 98° C., measured according to DIN 53,460 (VST/B/50) and a melt flow index of 8 g/10 min, measured according to DIN 53,735 (220/10), was immersed for 5 minutes in a solution of 1.7 g of N,N'-dicyano-p-benzoquinonediimine in 250 ml of toluene. After drying in the air, the molding was immersed for 1 minute in a solution of 2 g of copper(I) iodide in 200 ml of acetonitrile, the said molding becoming coated with a bluish black layer. The surface resistance of the molding decreased from $7 \cdot 10^{13}$ ohm before the treatment to $4.2 \cdot 10^5$ ohm after the treatment.

EXAMPLE 3

A molding of a commercial blend consisting of 60% by weight of a polycarbonate based on bisphenol A and 40% by weight of an ASA polymer of 30% by weight of butyl acrylate, 53% by weight of styrene and 17% by weight of acrylonitrile, having a Vicat softening temperature of 121° C., measured according to DIN 53,460 (VST/B/50) and a melt flow index of 4 g/10 min, measured according to DIN 53,735 (220/10), was treated as described in Example 2. The surface resistance decreased from $7 \cdot 10^{13}$ ohm to $7.1 \cdot 10^5$ ohm as a result of the treatment.

EXAMPLES 1–3

The samples treated as described in Examples 1 to 3 were stored in the air at 80° C., and the increase in the resistance was measured as a function of time. The results are summarized in the Table.

TABLE

| Surface resistance [Ω] after storage in air at 80° C., as a function of time. | | | |
|---|---|---|---|
| Time [days] | Example 1 | Example 2 | Example 3 |
| 0 | $1\ 10^6$ | $4.2\ 10^5$ | $7.1\ 10^5$ |
| 10 | $2.5\ 10^7$ | $4.1\ 10^6$ | $3.5\ 10^6$ |
| 20 | $7.4\ 10^7$ | $2.3\ 10^7$ | $3.7\ 10^7$ |
| 30 | $1.8\ 10^8$ | $1.7\ 10^8$ | $6.3\ 10^8$ |

EXAMPLE 4

A molding of the plastic used in Example 3 was immersed for 5 minutes in a solution of 1.7 g of N,N'-dicyano-p-benzoquinonediimine and 0.6 g of 2,5-dimethyl-N,N'-dicyano-p-benzoquinonediimine in 250 ml of toluene. After drying in the air, the molding was immersed for one minute in a solution of 2 g of copper(I) iodide in 200 ml of acetonitrile, the said molding becoming coated with a bluish black layer. The surface resistance decreased from $7 \cdot 10^{13}$ ohm to $4.2 \cdot 10^5$ ohm as a result of the treatment.

EXAMPLE 5

A molding of the plastic used in Example 2 was treated as described in Example 4. Its surface resistance decreased from $7 \cdot 10^{13}$ ohm to $2.4 \cdot 10^5$ ohm.

EXAMPLE 6

A molding of the plastic stated in Example 2 was sprayed with a solution of 1 g of copper(I) iodide in 100 ml of acetonitrile and dried in the air for 5 minutes. Thereafter, the same molding was sprayed with a solution of 0.85 g of N,N'-dicyanobenzoquinonediimine in 125 ml of toluene and again dried in the air. The surface resistance decreased to $1 \cdot 10^5$ ohm as a result of the treatment.

EXAMPLE 7

A molding of the plastic stated in Example 3 was treated as in Example 6. Thereafter, spraying with the acceptor solution was repeated twice. The surface resistance decreased to $2 \cdot 10^5$ ohm.

EXAMPLE 8

The procedure described in Example 7 was followed, except that the order of the treatment with copper(I) iodide solution and the acceptor solution was reversed. The surface resistance decreased to $5 \cdot 10^4$ ohm.

We claim:

1. A process for making an electrically conductive surface layer on a molding, comprising:

(i) coating a molding made of plastic which is soluble or swellable in organic solvents with a first solution of a tetracyanoquinonedimethane of the formula

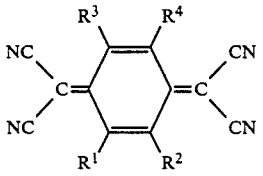

or of an N,N'-dicyanoquinonediimine of the formula

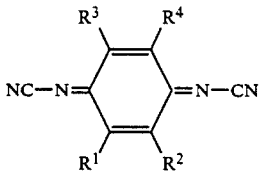

or a of a mixture of these compounds, where $R^1$, $R^2$, $R^3$ and $R^4$ independently of one another are each methyl, hydrogen, ethyl, propyl, isopropyl, methoxy, ethoxy, propoxy, butoxy, pentyloxy, methylthio, fluorine, chlorine, bromine or cyano, or one of the radicals $R^1$ and $R^2$ or one of the radicals $R^3$ and $R^4$ or one of the radicals $R^1$ and $R^2$ and one of the radicals $R^3$ and $R^4$ are phenyl or butyl, or $R^1$ and $R^2$ or $R^3$ and $R^4$ or $R^1$ and $R^2$ and $R^3$ and $R^4$ together form a radical of the formulae

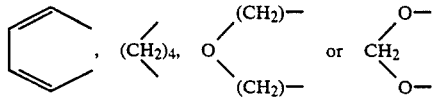

where the fused aromatic rings are unsubstituted or monosubstituted or disubstituted by chlorine, bromine, methoxy or methyl, to obtain diffusion of said first solution only into the surface of said molding;

(ii) drying the molding obtained in step (i);

(iii) coating the molding obtained in step (ii) with a second solution of a tetrachalcogenafulvalene of the formula

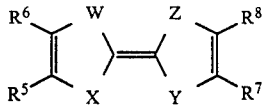

where $R^5$, $R^6$, $R^7$ and $R^8$ independently of one another are each hydrogen, methyl, ethyl, phenyl, methylphenyl or methoxyphenyl, or $R^5$ and $R^6$ or $R^7$ and $R^8$ or $R^5$ and $R^6$ and $R^7$ and $R^8$ together form a radical of the formulae

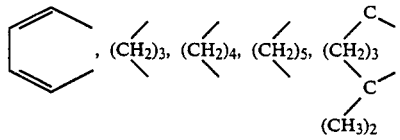

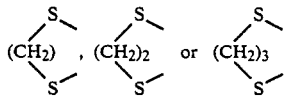

and X, Y, W and Z are each selenium or sulfur, or a solution of an iodide of the formula $M^{m+}I_m^-$ where M is an m-valent alkali metal, alkaline earth metal or transition metal, tin, lead, thallium, ammonium, phosphonium, arsonium or stibonium, copper, silver, pyridinium, N-methylpyridinium, quinolinium, N-methylquinolinium, phenazinium, N-methylphenazinium, tetramethylammonium, tetraethylammonium, tetrabenzylammonium, trimethylbenzylammonium or triethylbenzylammonium, and m is 1, 2 or 3, to obtain diffusion of said second solution only into the surface of said molding; and (iv) drying the molding obtained in step (iii) to obtain a molding having thereon an electrically conductive surface layer and in which the compositional integrity of the core of said molding has been unaffected by said steps (i) to (iv).

2. A process as claimed in claim 1, wherein the moldings are treated, in any order, (a) with a solution of a tetracyanoquinodimethane of the formula

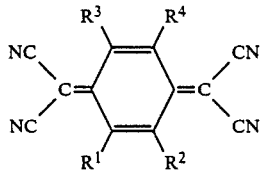

or of an N,N'-dicyanoquinonediimine of the formula

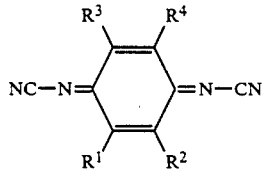

or of a mixture of these compounds and (c) with a solution of an iodide of the formula $M^{m\oplus} J_m^{\ominus}$ where M is copper, silver, pyridinium, N-methylpyridinium, quinolinium, N-methylquinolinium, phenazinium, N-methylphenazinium, tetramethylammonium, tetraethylammonium, tetrabenzylammonium, trimethylbenzylammonium or triethylbenzylammonium, and m is 1, 2 or 3.

3. A process as claimed in claim 2, wherein moldings of homo- or copolymers of styrene, α-methylstyrene, butadiene, acrylonitrile, methacrylonitrile or $C_1$–$C_{18}$-alkyl acrylates or methacrylates are treated.

4. A process as claimed in claim 2, wherein moldings of graft copolymers of styrene, acrylonitrile, butadiene and/or $C_1$–$C_{18}$-alkyl acrylates, or blends of these with polymers which contain carbonate groups in the main chain, are treated.

5. A process according to claim 1, wherein the moldings are treated, in any order, (a) with a solution of a tetracyanoquinonedimethane of the formula

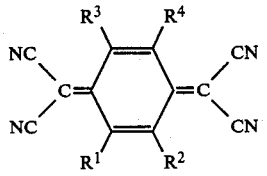

where $R^1$, $R^2$, $R^3$ and $R^4$ independently of one another are each methyl, hydrogen, ethyl, propyl, isopropyl, methoxy, ethoxy, propoxy, butoxy, pentyloxy, methylthio, fluorine, chlorine, bromine, or cyano, or one of the radicals $R^1$ and $R^2$ or one of the radicals $R^3$ and $R^4$ or one of the radicals $R^1$ and $R^2$ and one of the radicals $R^3$ and $R^4$ are phenyl or butyl, or $R^1$ and $R^2$ or $R^3$ and $R^4$ or $R^1$ and $R^2$ and $R^3$ and $R^4$ together form a radical of the formula

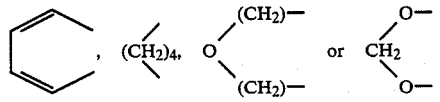

where the fused aromatic rings are unsubstituted or monosubstituted or disubstituted by chlorine, bromine, methoxy or methyl, and (b) with a solution of a tetrachalcogenafulvalene of the formula

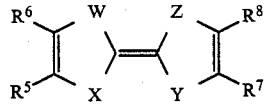

where $R^5$, $R^6$, $R^7$ and $R^8$ independently of one another are each hydrogen, methyl, ethyl, phenyl, methylphenyl or methoxyphenyl, or $R^5$ and $R^6$ or $R^7$ and $R^8$ or $R^5$ and $R^6$ and $R^7$ and $R^8$ together form a radical of the formula

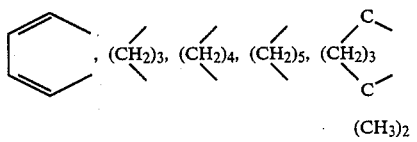

-continued

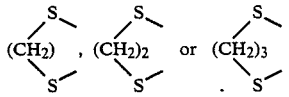

and X, Y, W and Z are each selenium or sulfur.

6. A process according to claim 1, wherein the moldings are treated, in any order, (a) with a solution of a tetracyanoquinonedimethane of the formula

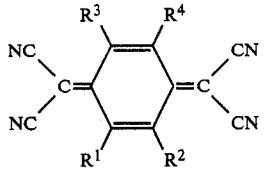

where $R^1$, $R^2$, $R^3$ and $R^4$ independently of one another are each methyl, hydrogen, ethyl, propyl, isopropyl, methoxy, ethoxy, propoxy, butoxy, pentyloxy, methylthio, fluorine, chlorine, bromine, or cyano, or one of the radicals $R^1$ and $R^2$ or one of the radicals $R^3$ and $R^4$ or one of the radicals $R^1$ and $R^2$ and one of the radicals $R^3$ and $R^4$ are phenyl or butyl, or $R^1$ and $R^2$ or $R^3$ and $R^4$ or $R^1$ and $R^2$ and $R^3$ and $R^4$ together form a radical of the formula

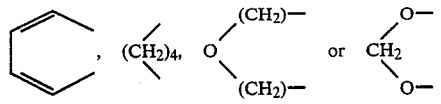

where the fused aromatic rings are unsubstituted or monosubstituted or disubstituted by chlorine, bromine, methoxy or methyl, and (c) with a solution of an iodide of the formula $M^{m\oplus} J_m^{\ominus}$, where M is an m-valent alkali metal, alkaline earth metal or transition metal, tin, lead, thallium, ammonium, phosphonium, arsonium or stibonium, copper, silver, pyridinium, N-methylpyridinium, quinolinium, N-methylquinolinium, phenazinium, N-methylphenazinium, tetramethylammonium, tetraethylammonium, tetrabenzylammonium, trimethylbenzylammonium or triethylbenzylammonium, and m is 1, 2 or 3.

7. A process as claimed in claim 1, wherein moldings of homo- or copolymers of styrene, α-methylstyrene, butadiene, acrylonitrile, methacrylonitrile or $C_1$–$C_{18}$-alkyl acrylates or methacrylates are treated.

8. A process according to claim 1, wherein the moldings are treated, in any order, (a) with a solution of a tetracyanoquinonedimethane of the formula

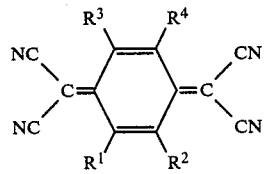

where $R^1$, $R^2$, $R^3$ and $R^4$ independently of one another are each methyl, hydrogen, ethyl, propyl, isopropyl, methoxy, ethoxy, propoxy, butoxy, pentyloxy, methylthio, fluorine, chlorine, bromine, or cyano, or one of the radicals $R^1$ and $R^2$ or one of the radicals $R^3$ and $R^4$ or one of the radicals $R^1$ and $R^2$ and one of the radicals $R^3$ and $R^4$ are phenyl or butyl, or $R^1$ and $R^2$ or $R^3$ and $R^4$ or $R^1$ and $R^2$ and $R^3$ and $R^4$ together form a radical of the formula

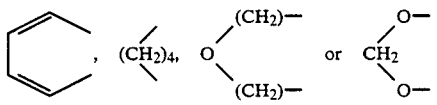

where the fused aromatic rings are unsubstituted or monosubstituted or disubstituted by chlorine, bromine, methoxy or methyl, and a solution of (b) and (c), wherein (b) is a solution of a tetrachalcogenafulvalene of the formula

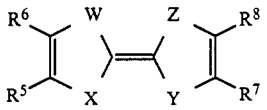

where $R^5$, $R^6$, $R^7$ and $R^8$ independently of one another are each hydrogen, methyl, ethyl, phenyl, methylphenyl or methoxyphenyl, or $R^5$ and $R^6$ or $R^7$ and $R^8$ or $R^5$ and $R^6$ and $R^7$ and $R^8$ together form a radical of the formula

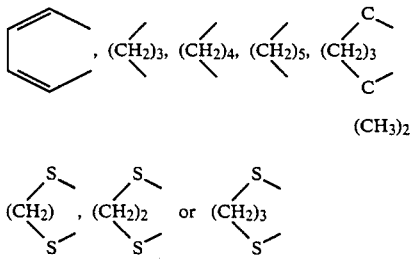

and X, Y, W and Z are each selenium or sulfur, and (c) is a solution of an iodide of the formula $$M^{m\oplus}J_m^{\ominus},$$

where M is an m-valent alkali metal, alkaline earth metal or transition metal, tin, lead, thallium, ammonium, phosphonium, arsonium or stibonium, copper, silver, pyridinium, N-methylpyridinium, quinolinium, N-methylquinolinium, phenazinium, N-methylphenazinium, tetramethylammonium, tetraethylammonium, tetrabenzylammonium, trimethylbenzylammonium or triethylbenzylammonium, and m is 1, 2 or 3.

9. A process as claimed in claim 1, wherein moldings of graft copolymers of styrene, acrylonitrile, butadiene and/or $C_1$–$C_{18}$-alkyl acrylates, or blends of these with polymers which contain carbonate groups in the main chain, are treated.

10. A process according to claim 1, wherein the moldings are treated, in any order, (a) with a solution of an N,N'-dicyanoquinonediimine of the formula

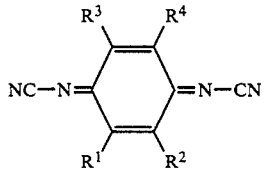

where $R^1$, $R^2$, $R^3$ and $R^4$ independently of one another are each methyl, hydrogen, ethyl, propyl, isopropyl, methoxy, ethoxy, propoxy, butoxy, pentyloxy, methylthio, fluorine, chlorine, bromine, or cyano, or one of the radicals $R^1$ and $R^2$ or one of the radicals $R^3$ and $R^4$ or one of the radicals $R^1$ and $R^2$ and one of the radicals $R^3$ and $R^4$ are phenyl or butyl, or $R^1$ and $R^2$ or $R^3$ and $R^4$ or $R^1$ and $R^2$ and $R^3$ and $R^4$ together form a radical of the formula

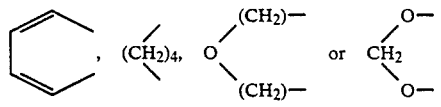

where the fused aromatic rings are unsubstituted or monosubstituted or disubstituted by chlorine, bromine, methoxy or methyl, and (b) with a solution of a tetrachalcogenafulvalene of the formula

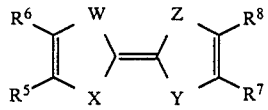

where $R^5$, $R^6$, $R^7$ and $R^8$ independently of one another are each hydrogen, methyl, ethyl, phenyl, methylphenyl or methoxyphenyl, or $R^5$ and $R^6$ or $R^7$ and $R^8$ or $R^5$ and $R^6$ and $R^7$ and $R^8$ together form a radical of the formula

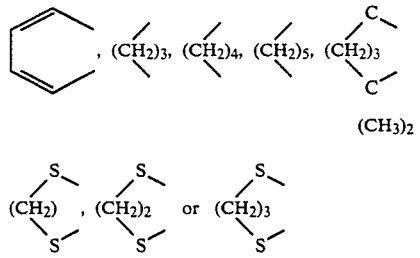

and X, Y, W and Z are each selenium or sulfur.

11. A process according to claim 1, wherein the moldings are treated, in any order, (a) with a solution of an N,N'-dicyanoquinonediimine of the formula

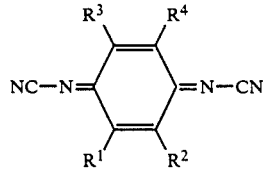

where $R^1$, $R^2$, $R^3$ and $R^4$ independently of one another are each methyl, hydrogen, ethyl, propyl, isopropyl, methoxy, ethoxy, propoxy, butoxy, pentyloxy, methylthio, fluorine, chlorine, bromine, or cyano, or one of the radicals $R^1$ and $R^2$ or one of the radicals $R^3$ and $R^4$ or one of the radicals $R^1$ and $R^2$ and one of the radicals $R^3$ and $R^4$ are phenyl or butyl, or $R^1$ and $R^2$ or $R^3$ and $R^4$ or $R^1$ and $R^2$ and $R^3$ and $R^4$ together form a radical of the formula

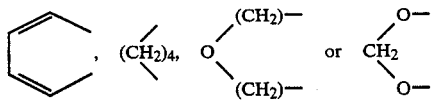

where the fused aromatic rings are unsubstituted or monosubstituted or disubstituted by chlorine, bromine, methoxy or methyl, and (c) with a solution of an iodide of the formula $$M^{m\oplus}J_m^{\ominus},$$

where M is an m-valent alkali metal, alkaline earth metal or transition metal, tin, lead, thallium, ammonium, phosphonium, arsonium or stibonium, copper, silver, pyridinium, N-methylpyridinium, quinolinium, N-methylquinolinium, phenazinium, N-methylphenazinium, tetramethylammonium, tetraethylammonium, tetrabenzylammonium, trimethylbenzylammonium or triethylbenzylammonium, and m is 1, 2 or 3.

12. A process according to claim 1, wherein the moldings are treated, in any order, (a) with a solution of an N,N'-dicyanoquinonediimine of the formula

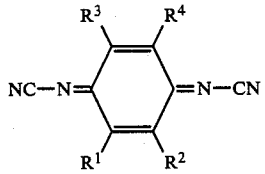

where $R^1$, $R^2$, $R^3$ and $R^4$ independently of one another are each methyl, hydrogen, ethyl, propyl, isopropyl, methoxy, ethoxy, propoxy, butoxy, pentyloxy, methylthio, fluorine, chlorine, bromine, or cyano, or one of the radicals $R^1$ and $R^2$ or one of the radicals $R^3$ and $R^4$ or one of the radicals $R^1$ and $R^2$ and one of the radicals $R^3$ and $R^4$ are phenyl or butyl, or $R^1$ and $R^2$ or $R^3$ and $R^4$ or $R^1$ and $R^2$ and $R^3$ and $R^4$ together form a radical of the formula

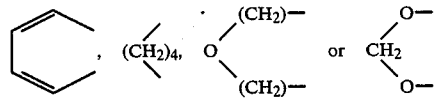

where the fused aromatic rings are unsubstituted or monosubstituted or disubstituted by chlorine, bromine, methoxy or methyl, and a solution of (b) and (c), wherein (b) is a solution of a tetrachalcogenafulvalene of the formula

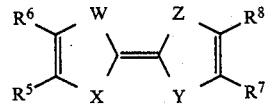

where $R^5$, $R^6$, $R^7$ and $R^8$ independently of one another are each hydrogen, methyl, ethyl, phenyl, methylphenyl or methoxyphenyl, or $R^5$ and $R^6$ or $R^7$ and $R^8$ or $R^5$ and $R^6$ and $R^7$ and $R^8$ together form a radical of the formula

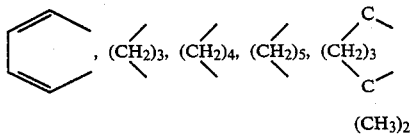

and X, Y, W and Z are each selenium or sulfur, and (c) is a solution of an iodide of the formula $$M^{m\oplus}J_m^{\ominus},$$

where M is an m-valent alkali metal, alkaline earth metal or transition metal, tin, lead, thallium, ammonium, phosphonium, arsonium or stibonium, copper, silver, pyridinium, N-methylpyridinium, quinolinium, N-methylquinolinium, phenazinium, N-methylphenazinium, tetramethylammonium, tetraethylammonium, tetrabenzylammonium, trimethylbenzylammonium or triethylbenzylammonium, and m is 1, 2 or 3.

13. A process according to claim 1, wherein the moldings are treated, in any order, (a) with a solution of a tetracyanoquinonedimethane of the formula

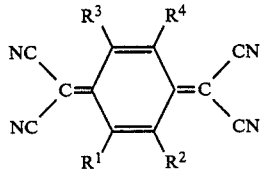

and an N,N'-dicyanoquinonediimine of the formula

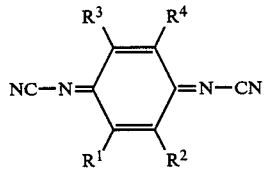

where $R^1$, $R^2$, $R^3$ and $R^4$ independently of one another are each methyl, hydrogen, ethyl, propyl, isopropyl, methoxy, ethoxy, propoxy, butoxy, pentyloxy, methylthio, fluorine, chlorine, bromine, or cyano, or one of the radicals $R^1$ and $R^2$ or one of the radicals $R^3$ and $R^4$ or one of the radicals $R^1$ and $R^2$ and one of the radicals $R^3$ and $R^4$ are phenyl or butyl, or $R^1$ and $R^2$ or $R^3$ and $R^4$ or $R^1$ and $R^2$ and $R^3$ and $R^4$ together form a radical of the formula

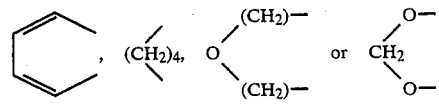

where the fused aromatic rings are unsubstituted or monosubstituted or disubstituted by chlorine, bromine, methoxy or methyl, and (b) with a solution of a tetrachalcogenafulvalene of the formula

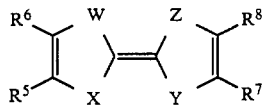

where $R^5$, $R^6$, $R^7$ and $R^8$ independently of one another are each hydrogen, methyl, ethyl, phenyl, methylphenyl or methoxyphenyl, or $R^5$ and $R^6$ or $R^7$ and $R^8$ or $R^5$ and $R^6$ and $R^7$ and $R^8$ together form a radical of the formula

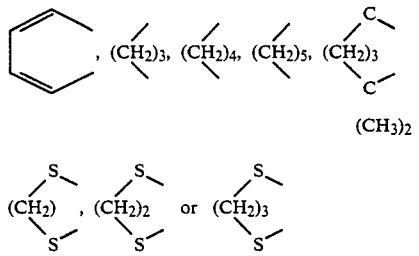

and X, Y, W and Z are each selenium or sulfur.

14. A process according to claim 1, wherein the moldings are treated, in any order, (a) with a solution of a tetracyanoquinonedimethane of the formula

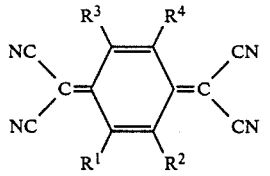

and an N,N'-dicyanoquinonediimine of the formula

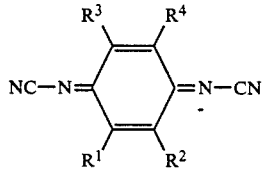

where $R^1$, $R^2$, $R^3$ and $R^4$ independently of one another are each methyl, hydrogen, ethyl, propyl, isopropyl, methoxy, ethoxy, propoxy, butoxy, pentyloxy, methylthio, fluorine, chlorine, bromine, or cyano, or one of the radicals $R^1$ and $R^2$ or one of the radicals $R^3$ and $R^4$ or one of the radicals $R^1$ and $R^2$ and one of the radicals $R^3$ and $R^4$ are phenyl or butyl, or $R^1$ and $R^2$ or $R^3$ and $R^4$ or $R^1$ and $R^2$ and $R^3$ and $R^4$ together form a radical of the formula

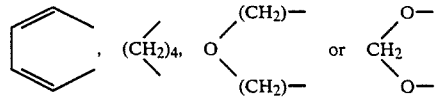

where the fused aromatic rings are unsubstituted or monosubstituted or disubstituted by chlorine, bromine, methoxy or methyl, and (c) with a solution of an iodide of the formula $$M^{m\oplus}J_m^{\ominus},$$

where M is an m-valent alkali metal, alkaline earth metal or transition metal, tin, lead, thallium, ammonium, phosphonium, arsonium or stibonium, copper, silver, pyridinium, N-methylpyridinium, quinolinium, N-methylquinolinium, phenazinium, N-methylphenazinium, tetramethylammonium, tetraethylammonium, tetrabenzylammonium, trimethylbenzylammonium or triethylbenzylammonium, and m is 1, 2 or 3.

15. A process according to claim 1, wherein the moldings are treated, in any order, (a) with a solution of a tetracyanoquinonedimethane of the formula

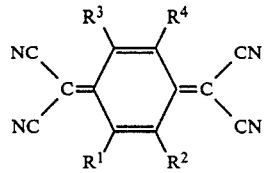

and an N,N'-dicyanoquinonediimine of the formula

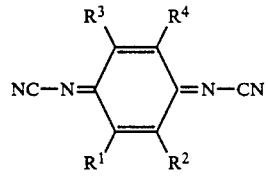

where $R^1$, $R^2$, $R^3$ and $R^4$ independently of one another are each methyl, hydrogen, ethyl, propyl, isopropyl, methoxy, ethoxy, propoxy, butoxy, pentyloxy, methylthio, fluorine, chlorine, bromine, or cyano, or one of the radicals $R^1$ and $R^2$ or one of the radicals $R^3$ and $R^4$ or one of the radicals $R^1$ and $R^2$ and one of the radicals $R^3$ and $R^4$ are phenyl or butyl, or $R^1$ and $R^2$ or $R^3$ and $R^4$ or $R^1$ and $R^2$ and $R^3$ and $R^4$ together form a radical of the formula

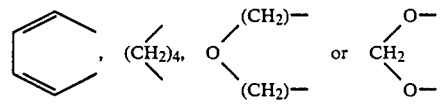

where the fused aromatic rings are unsubstituted or monosubstituted or disubstituted by chlorine, bromine, methoxy or methyl, and a solution of (b) and (c), wherein (b) is a solution of a tetrachalcogenafulvalene of the formula

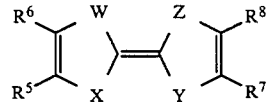

where $R^5$, $R^6$, $R^7$ and $R^8$ independently of one another are each hydrogen, methyl, ethyl, phenyl, methylphenyl or methoxyphenyl, or $R^5$ and $R^6$ or $R^7$ and $R^8$ or $R^5$ and $R^6$ and $R^7$ and $R^8$ together form a radical of the formula

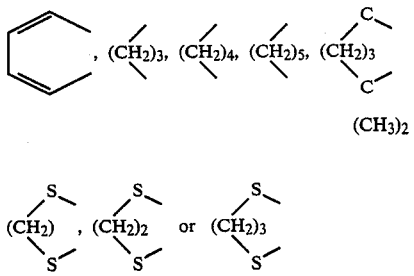

and X, Y, W and Z are each selenium or sulfur, and (c) is a solution of an iodide of the formula $$M^{m\oplus}J_m^{\ominus},$$

where M is an m-valent alkali metal, alkaline earth metal or transition metal, tin, lead, thallium, ammonium, phosphonium, arsonium or stibonium, copper, silver, pyridinium, N-methylpyridinium, quinolinium, N-methylquinolinium, phenazinium, N-methylphenazinium, tetramethylammonium, tetraethylammonium, tetrabenzylammonium, trimethylbenzylammonium or triethylbenzylammonium, and m is 1, 2 or 3.

* * * * *